US005095248A

United States Patent [19]

Sato

[11] Patent Number: 5,095,248

[45] Date of Patent: Mar. 10, 1992

[54] ELECTROLUMINESCENT DEVICE DRIVING CIRCUIT

[75] Inventor: Yoshihide Sato, Kanagawa, Japan

[73] Assignee: Fuji Xerox Co., Ltd., Tokyo, Japan

[21] Appl. No.: 596,494

[22] Filed: Oct. 12, 1990

[30] Foreign Application Priority Data

Nov. 24, 1989 [JP] Japan ..... 1-305899

[51] Int. Cl.[5] ..... G09G 3/10; G09G 3/30

[52] U.S. Cl. ..... 315/169.3; 315/246; 340/781

[58] Field of Search ..... 315/169.3, 246; 340/781

[56] References Cited

U.S. PATENT DOCUMENTS

| | | | |
|---|---|---|---|
| 3,708,717 | 1/1973 | Fleming | 340/781 |
| 4,006,383 | 2/1977 | Luo et al. | 315/169.3 |
| 4,087,792 | 5/1978 | Asars | 315/169.3 |
| 4,114,070 | 9/1991 | Asars | 315/169.3 |
| 4,574,315 | 3/1986 | Yoshimura | 315/169.3 |
| 4,602,192 | 7/1986 | Nomura et al. | 315/169.3 |

*Primary Examiner*—Eugene R. Laroche
*Assistant Examiner*—Tan Dinh
*Attorney, Agent, or Firm*—Finnegan, Henderson, Farabow, Garrett, and Dunner

[57] ABSTRACT

An electroluminescent device driving circuit comprising first and second switching devices, a dividing capacitor, an electroluminescent device, a driving power supply, and a current limiting resistor disposed in series between the second switching device and the electroluminescent device is described. The electroluminescent device illuminates when the second switching device is in the on-state (closed). When the second switching device is in the off-state (open), however, the electroluminescent device does not emit light. Since a current limiting resistor is disposed in series with the electroluminescent device and the second switching device, the current that flows through the second switching device when the electroluminescent device is illuminated is reduced. Further, in the event that the second switching device is turned off, it is possible to limit the amount of discharging current from a capacitive load.

8 Claims, 3 Drawing Sheets

ELECTROLUMINESCENT DEVICE DRIVING CIRCUIT

BACKGROUND OF THE INVENTION

The present invention relates to an electroluminescent device driving circuit used in exposure systems of matrix type electroluminescent display devices and electronic type printing apparatuses. In particular, the present invention relates to a circuit structure of an electroluminescent device driving circuit using amorphous silicon (a-Si) as the semiconductor layer of a film transistor for driving an electroluminescent device.

Description of the Related Art

FIG. 5 shows an electroluminescent device driving circuit for one bit of a matrix type electroluminescent display device or electroluminescent device array. The electroluminescent device circuit comprises a first switching device Q1, a storage capacitor Cs whose one terminal is connected to the source terminal of the first switching device Q1, a second switching device Q2 whose gate terminal is connected to the source terminal of the first switching device Q1 and whose source terminal is connected to the other terminal of the storage capacitor Cs, an electroluminescent device CEL whose one terminal is connected to the drain terminal of the second switching device Q2 and whose other terminal is connected to an electroluminescent device driving power supply Va, and a dividing capacitor Cdv which is connected in parallel with the second switching device Q2. The first switching device Q1 is turned on according to a switching signal SCAN. When the first switching device Q1 is turned on or off, it causes the storage capacitor Cs to be charged or discharged according to a luminance signal DATA. When the discharging voltage from the storage capacitor Cs is applied to the gate terminal, the second switching device Q2 is turned on, thereby causing the electroluminescent device CEL to become luminous by the electroluminescent device driving power supply Va.

According to the electroluminescent device driving circuit described above, when the second switching device Q2 is turned off, the electroluminescent device driving power supply Va is applied between the drain and the source of the second switching device Q2. Thus, when the state of the second switching device Q2 is changed from ON to OFF, a voltage corresponding to a DC component of electric charge stored in the dividing capacitor Cdv and the electroluminescent device driving power supply Va are added and applied across the drain and source of switching device Q2. Consequently, switching device Q2 must have a high withstand voltage, approximately twice the electroluminescent device driving power supply Va, and a low-off current. In order to realize a second switching device having these characteristics the semiconductor layer included in the second switching device Q2 may be made of cadmium selenide (CdSe) or polysilicon (polySi)/

However, as cadmium selenide degrades with time, the drain current vs. drain voltage characteristic becomes unstable and therefore it is difficult to keep the luminance of the electroluminescent device CEL constant. On the other hand, polysilicon (polySi) is deposited at a high temperature. Thus, it is difficult to form a large size device by depositing the electroluminescent device CEL and the second switching device Q2 on the same substrate.

To solve the problems associated with cadmium selenide (CdSe) and polysilicon (polySi), amorphous silicon (a-Si) may be used as the semiconductor layer. However, switching devices using amorphous silicon cannot be designed to withstand a high voltage. In addition, as shown in FIG. 6, the switching device incorporating amorphous silicon as the semiconductor layer is characterized in that the OFF-current substantially increased upon application of a drain voltage in excess of 50V. Thus, power consumption of the switching device increased under these conditions. However, a high withstand voltage can be obtained if the switching device incorporates amorphous silicon as the semiconductor layer and has an offset drain structure. However, in this structure, the negative off-current is decreased when the electroluminescent device driving power is negative. Thus, a voltage enough to cause the electroluminescent device CEL to be luminous cannot be obtained. Consequently, with the driving circuit as shown in FIG. 5, the electroluminescent device CEL cannot be driven.

SUMMARY OF THE INVENTION

An object of the present invention is to solve the aforementioned problems and to provide an electroluminescent device driving circuit wherein the semiconductor layer of a film transistor which drives an electroluminescent device can be formed by using amorphous silicon (a-Si).

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises: a first switching device having first, second, and third terminals, the second terminal acting to open or close said first switching device in accordance with a switching signal applied thereto, wherein a current flows between the first and third terminals when said first switching device is closed; a second switching device having first, second, and third terminals, the second terminal acting to close said second switching device in accordance with a voltage applied thereto, wherein a current flows between the first and third terminals when said first switching device is closed, wherein the third terminal of said first switching device is electrically coupled to the second terminal of said second switching device; an electroluminescent device having first and second terminals; and current limiting means for limiting the flow of current through said second switching device, such that said current limiting means is disposed in series with said electroluminescent device and said second switching means.

According to the present invention, since a current limiting means is disposed in series with the electroluminescent device and the second switching device, the current that flows through the second switching device when the electroluminescent device is illuminated is reduced. Further, in the event that the second switching device is turned off, it is possible to limit the amount of discharging current from a capacitive load. Thus, rather than employing the offset structure, amorphous silicon can be used as a semiconductor layer of the second switching device.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
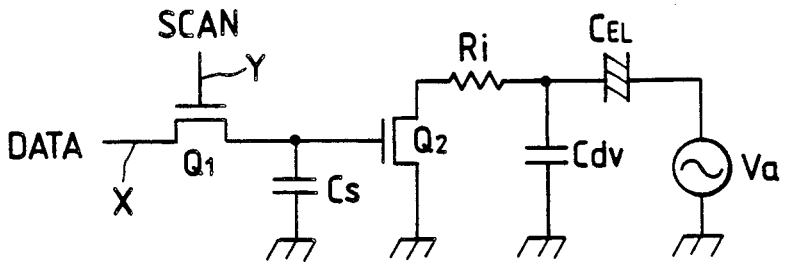
FIG. 1 is a schematic of an electroluminescent device driving circuit of an embodiment of the present invention.

FIG. 1 is a circuit diagram of an electroluminescent device driving circuit according to an embodiment of the present invention. The diagram shows the electroluminescent device driving circuit for one bit of a matrix type electroluminescent display device and an electroluminescent device array.

The first switching device Q1 is structured in such manner that the luminance signal DATA is supplied to an information signal line X to the drain thereof. The minus (−) terminal of storage capacitor Cs is grounded and the (+) terminal is connected to the source of the first switching device. The switching signal SCAN is applied to a switching signal line Y connected to the gate of the first switching device Q1. The source of the first switching device Q1 is connected to the gate of the second switching device Q2. The electroluminescent device driving power supply Va (Va=V pk sin (ωt), the dividing capacitor Cdv, and the electroluminescent device CEL are connected in series. The drain of the second switching device Q2 is connected through the current limiting resistor Ri to the connection point of the dividing capacitor Cdv and the electroluminescent device CEL. The source of the second switching device Q2 is grounded. Thus, the current limiting resistor Ri is disposed in series between the electroluminescent device CEL and the second switching device Q2.

Figure 2:
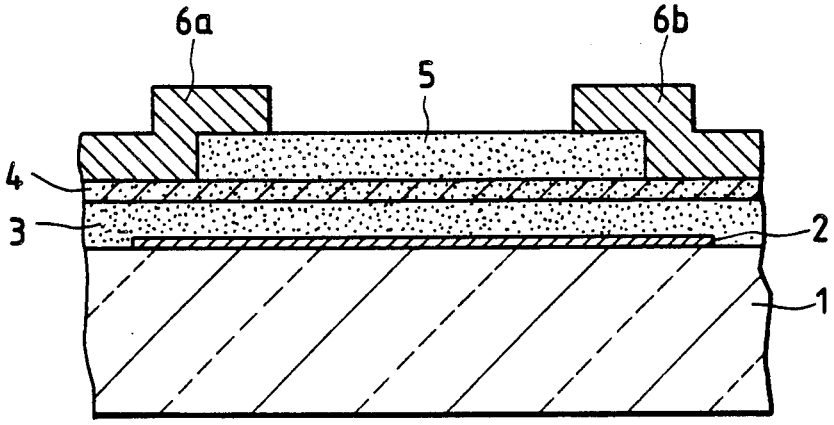
FIG. 2 is a descriptive sectional schematic of a switching device according to the embodiment.

As shown in FIG. 2, the second switching device Q2 comprises a substrate 1, a gate electrode 2 made of a metal such as chromium (Cr) or the like, an insulation layer 3 made of $SiN_x$, a semiconductor layer 4 made of amorphous silicon (a-Si), an upper insulation layer 5, a drain electrode 6*a*, and a source electrode 6*b*, each of which is layered on the substrate 1 in that order.

Figure 6:
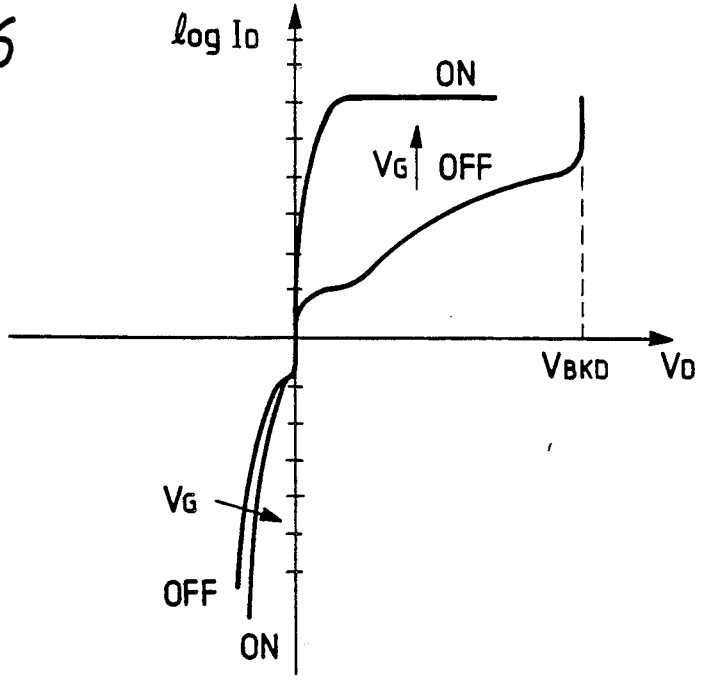
FIG. 6 is a characteristic schematic of drain current vs. drain voltage of a switching device using amorphous silicon as the semiconductor layer.

FIG. 6 shows a characteristic of drain current vs. drain voltage of the second switching device Q2.

By referring to drive waveforms shown in FIG. 3, the operation of the aforementioned driving circuit will be described as follows.

Figures 3A, 3B, 3C, 3D, 3E:
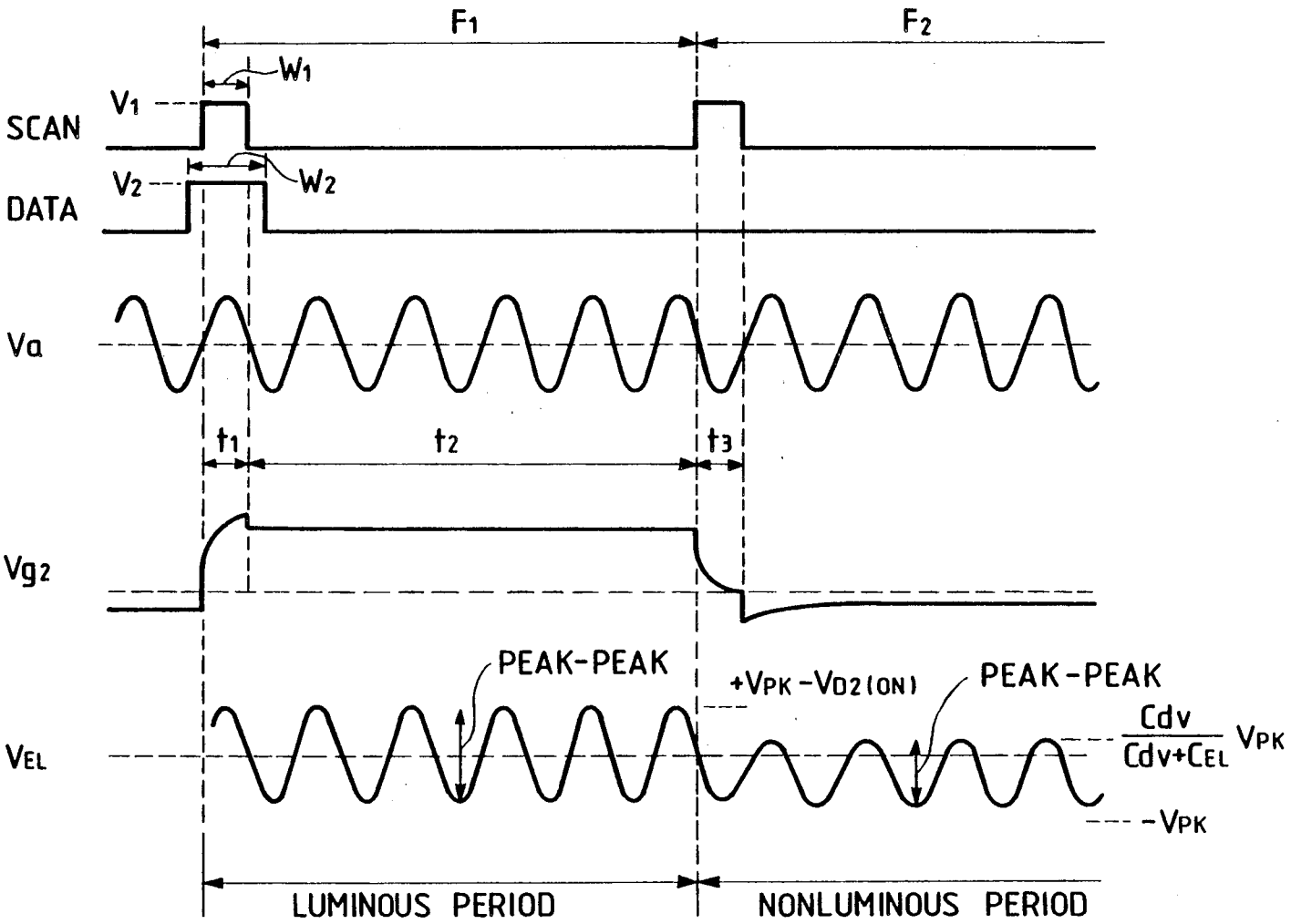
FIG. 3(*a*) through 3(*e*) is a timing diagram showing the operation of the electroluminescent device driving circuit according to the present invention.

As shown in FIG. 3 (*a*), when the switching signal SCAN having pulse width W1 and pulse voltage is V1 is applied via the switching signal line Y to the gate of the first switching device Q1 in time period t1 of frame time period F1, the state of the first switching device Q1 becomes closed (ON). At the same time, as shown in FIG. 3 (*b*), when the luminance signal DATA having pulse width W2 and pulse voltage V2 is applied, the storage capacitor Cs is charged through the ON resistance (Ron) of the first switching device Q1. At that time, the voltage Vcs at both the terminals of the storage capacitor Cs changes according to Vcs=V2 (1 − exp (−t τ1) as shown in FIG. 3 (*d*) (τ1=Ron x Cs).

After the time period t1 elapsed, the voltage V2 of the information signal line X becomes 0 and the state of the first switching device Q1 becomes open (OFF). At that time, the electric charge being charged in the storage capacitor Cs starts discharging through the off-resistance (Roff) of the first switching device Q1. The gate voltage Vg2 is the same as the voltage Vcs across the terminals of the storage capacitor Cs and varies in the time period t2 according to Vcs=Vg2=V2 exp (−t / τ2)) (τ2=Roff×Cs) as shown in FIG. 3 (*d*).

In the subsequent frame time period F2, if the switching signal SCAN having pulse width W1 and the pulse voltage V1 is applied to the gate of the first switching device Q1 and the voltage of the luminance signal DATA is 0, the electric charge stored in the storage capacitor Cs is discharged in the time period t3 (time constant τ1). Consequently, the voltage Vcs at the storage capacitor Cs becomes O (FIG. 3 (*d*)).

As shown in FIG. 1, the aforementioned voltage Vcs is equal to the gate voltage Vg2 of the second switching device Q2. Thus, when the voltage Vcs (Vg2) becomes high, the second switching device Q2 becomes closed (ON) and the resistance thereof becomes low. Accordingly, VEL has an amplitude on the positive side of the waveform of Vpk − VD2(on) (VD2 is a voltage between the drain and the source of the second switching device Q2 when it becomes closed (ON)) and an amplitude on the negative side of the waveform of approximately −Vpk (where Vpk is the amplitude of Va), as shown in FIG. 3(*e*), because the waveform is affected slightly by asymmetries of Q2 explained below.

When Q2 is open (OFF), little drain current flows, at least for the normal polarity of voltage across the source and drain. Consequently, the amplitude VEL on the positive side of the waveform is:

$$VEL=(Va \times Cdv) / (CEL + Cdv).$$

However, as shown in FIG. 6, the drain current of switching device Q2 is dependent, in part, upon whether the drain voltage is positive or negative. As seen in FIG. 6, upon application of a negative drain voltage, a large drain current flows even when the second switching device Q2 is off. Therefore, the amplitude of VEL on the negative side of the waveform is approximately −Vpk, as shown in FIG. 3(*e*).

The electroluminescent device CEL emits light at a threshold level upon application of a threshold voltage VTEL across its terminals. A desired luminosity can be achieved, however, by adding an additional voltage VMOD to the threshold voltage VTEL. The electroluminescent device emits light when the second switching device Q2 is in the ON-state (closed). Thus, Vpk−VD2(ON), the peak amplitude of VEL on the positive half of the cycle is set to a value substantially equal to VTEL +VMOD in order to achieve a desired luminosity. The peak amplitude of VEL is slightly greater (approx. −Vpk) on the negative half of the cycle (see above) and yields essentially the same luminosity.

Thus, as shown in FIG. 3(*e*), when the second switching device Q2 is closed (ON), the waveform of the voltage VEL applied at both the electrodes of the electroluminescent device CEL becomes essentially symmetrical with respect to both the electrodes.

On the other hand, when the second switching device Q2 is open (OFF), VEL has an asymmetrical waveform such that the amplitude on the positive side is reduced.

When the second switching device Q2 is in the OFF-state (open), the electroluminescent device CEL should not emit light; and the peak amplitude of VEL must necessarily be set to a value below the threshold voltage VTEL. Neither peak value applied to CEL when Q2 is in the OFF state will be sufficient to turn CEL on, if the voltage reduction from the capacitive voltage division effect described above is strong enough, because of an average voltage shifting affect from the predominantly capacitive impedance in series with CEL when Q2 is in the OFF state. In other words, the effective peak voltage on each half of the cycle will be close to half of the peak-to-peak value.

Thus with appropriate choices of Cdv and $V_{MOD}$ the waveform is appropriately proportioned with respect to the aforementioned (threshold voltage VTEL) so that when the second switching device Q2 is closed (ON), the electroluminescent device CEL becomes luminous; when the second switching device Q2 is open (OFF), the electroluminescent device CEL is not luminous.

According to the aforementioned driving circuit, amorphous silicon can be used as the semiconductor layer of the second switching device Q2 (TFT). Assuming that the capacitance of the electroluminescent device CEL is nearly equal that of the dividing capacitor Cdv, when the second switching device Q2 is open (OFF), the drain voltage VD nearly equals VEL and thus a high voltage is applied to the drain of the second switching device Q2, in the absence of a current limiting resistor. Consequently, the insulation of the second switching device Q2 may be destroyed. However, according to the present invention, a current limiting resistor Ri protects the second switching device Q2 from the discharge of the capacitive load Cdv and CEL. As shown in FIG. 1, this current limiting resistor Ri is disposed in series between the electroluminescent device CEL and the second switching device Q2. Thus, even if the second switching device Q2 does not have a high withstand voltage equal to the voltage $V_a$, it is possible to prevent the second switching device Q2 from being destroyed. Therefore, reliability of the second switching device Q2 can be improved.

The value of the current limiting resister Ri is determined in the following manner. Assuming that the ON-current necessary for driving the electroluminescent device is ID (on); the ON-voltage is VD (on); the threshold voltage is VTEL; and the modulation voltage is VMOD, in the luminous time period that the second switching device Q2 is closed (ON), it is necessary to set Ri so that the following equation is satisfied.

$$2Va - (VD\ (on) + ID\ (on) \times Ri) \geqq 2\ (VTEL + VMOD)$$

Figure 4:
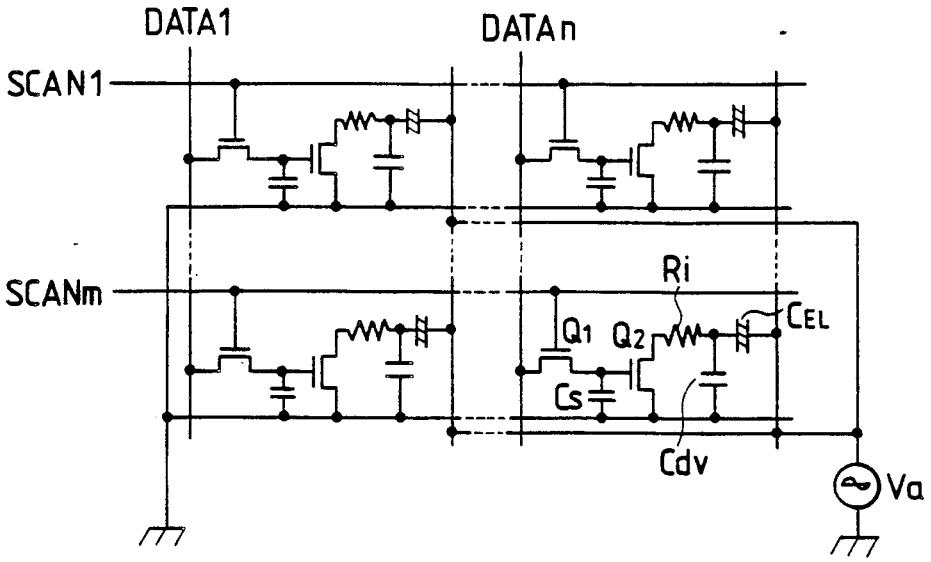
FIG. 4 shows a driving circuit in a matrix type electroluminescent display device embodying the present invention.
Figure 5:
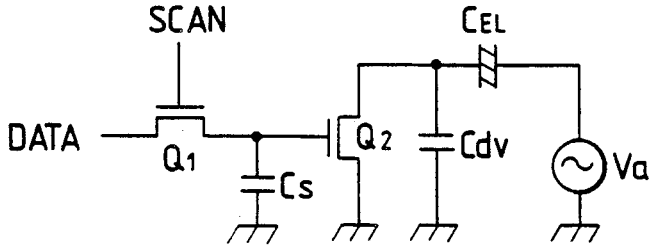
FIG. 5 is a diagram of a conventional electroluminescent device driving circuit.

FIG. 4 shows a driving circuit of a matrix type electroluminescent display device having m x n bits, embodying the present invention. In the figure, a plurality of driving circuits for one picture element shown in FIG. 1 are disposed vertically and horizontally, the gates of the first switching devices Q1 of each driving circuit disposed horizontally being connected to the switching signal lines Y (SCAN1..SCANm), the information signal lines X (DATA1..DATAn) of each driving circuit are disposed vertically and are connected to the drains of the first switching devices Q1. The same portions as FIG. 1 are identified with the same letters and their description is omitted.

According to the aforementioned embodiment, by using amorphous silicon (a-Si) as the semiconductor layer of the second switching device Q2, large devices with improved characteristics can be easily produced. These devices are suitable for matrix type electroluminescent display devices and electroluminescent device arrays.

It will be apparent to those skilled in the art that various modifications and variations can be made in the electroluminescent device driving circuit of the present invention and in construction of this electroluminescent device driving circuit without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electroluminescent device driving circuit comprising:

a first switching device having first, second, and third terminals, the second terminal acting to open or close said first switching device in accordance with a switching signal applied thereto, wherein a current flows between the first and third terminals when said first switching device is closed;

a second switching device having first, second, and third terminals, the second terminal acting to close said second switching device in accordance with a voltage applied thereto, wherein a current flows between the first and third terminals when said first switching device is closed, wherein the third terminal of said first switching device is electrically coupled to the second terminal of said second switching device;

an electroluminescent device having first and second terminals;

current limiting means for limiting the flow of current through said second switching device, such that said current limiting means is disposed in series with said electroluminescent device and said second switching; and a dividing capacitor having first and second terminals, said first terminal of said dividing capacitor being electrically coupled to said current limiting means and said second terminal of said electroluminescent device, and said second terminal of said dividing capacitor being adapted for coupling to an electroluminescent device driving power supply.

2. The electroluminescent device driving circuit of claim 1 wherein the first, second, and third terminals of said first and second switching devices are drain, gate, and source terminals respectively.

3. The electroluminescent device driving circuit of claim 1, further comprising a storage capacitor such that said storage capacitor is charged or discharged in accordance with said switching signal and said voltage applied to the second terminal of the second switching device is a discharge voltage from said storage capacitor.

4. The electroluminescent device driving circuit of claims 1 or 3, further comprising:

an electroluminescent device driving power supply having first and second terminals, wherein the first terminal of said electroluminescent device driving power supply is electrically coupled to the first terminal of said electroluminescent device, said second terminal of said electroluminescent device is electrically coupled to said current limiting means and said first terminal of said dividing capacitor, and said second terminal of said dividing capacitor is electrically coupled to said second terminal of said electroluminescent device driving power supply.

5. The electroluminescent device driving circuit of claim 4, wherein the first, second, and third terminals of said first and second switching devices are drain, gate, and source terminals respectively.

6. The electroluminescent device driving circuit of claim 1, wherein said second switching device comprises a semiconductor layer.

7. The electroluminescent device driving circuit of claim 6, wherein said semiconductor layer is amorphous silicon.

8. The electroluminescent device driving circuit of claim 1, wherein said current limiting means comprises a current limiting resistor.

* * * * *